US005720829A

United States Patent [19]

Finkl et al.

[11] Patent Number: 5,720,829

[45] Date of Patent: Feb. 24, 1998

[54] MARAGING TYPE HOT WORK IMPLEMENT OR TOOL AND METHOD OF MANUFACTURE THEREOF

[75] Inventors: Charles W. Finkl, Evanston; Guy A. Brada, Chicago; Algirdas A. Underys, Arlington Heights, all of Ill.

[73] Assignee: A. Finkl & Sons Co., Chicago, Ill.

[21] Appl. No.: 595,615

[22] Filed: Feb. 2, 1996

Related U.S. Application Data

[63] Continuation-in-part of Ser. No. 400,682, Mar. 8, 1995, abandoned.

[51] Int. Cl.[6] ..... C22C 38/04; C22C 38/06; C22B 9/04

[52] U.S. Cl. ..... 148/307; 148/309; 148/326; 75/512

[58] Field of Search ..... 420/63, 53, 79, 420/80, 109; 148/326, 328, 307, 309; 75/512

[56] References Cited

FOREIGN PATENT DOCUMENTS

| | | | |
|---|---|---|---|
| 61-96061 | 5/1986 | Japan | 420/63 |
| 984171 | 2/1965 | United Kingdom | 420/53 |

*Primary Examiner*—Deborah Yee
*Attorney, Agent, or Firm*—James G. Staples

[57] ABSTRACT

A maraging type magnetic hot work implement, such as a forging die, or a tool, such as a turbine blade, having $Ni_3Mo$, $Ni_3Al$ and, preferably, $Ni_3Ti$ strengthening precipitates dispersed uniformly, and being substantially Co free, said product having the following approximate composition by weight percent:

| | |
|---|---|
| C | less than .20 |
| Mn | .80 max |
| P | .015 max |
| S | .010 max |
| Si | .15–.35 |
| Ni | 6.00–16.00 |
| Cr | 6.00–14.00 |
| Mo | 2.00–6.00 |
| V | 0.3–.15 |
| Ti | 0.00–4.00 |
| Al | .20–8.00 |
| Fe | balance together with incidental impurities and other elements not significantly adversely affecting performance |

and methods of manufacture thereof.

8 Claims, No Drawings

MARAGING TYPE HOT WORK IMPLEMENT OR TOOL AND METHOD OF MANUFACTURE THEREOF

This application is a continuation-in-part of application Ser. No. 08/400,682 filed Mar. 8, 1995, now abandoned.

This invention relates generally to maraging type hot work implements or tools, and particularly a ferrous alloy which is precipitation hardening and magnetic and does not require the presence of the exceedingly expensive alloying element cobalt which is frequently employed in maraging alloy compositions.

BACKGROUND OF THE INVENTION

A group of iron-nickel compositions has been developed which contain so little carbon that they are referred to as carbon-free, iron-nickel martensites. As is well known, iron-carbon martensite is hard and brittle in the as-quenched condition and becomes softer and more ductile when tempered. Carbon-free iron-nickel martensite on the other hand is relatively soft and ductile in the as quenched condition, for example $R_c$24, and becomes hard, strong and tough when aged. After early work a family of 18% Ni steels was developed containing 7–9½ cobalt, 3–5% molybdenum, and 0.1–0.8% titanium and as little carbon as possible; indeed one group of such alloys contained only about 0.01 C. Cobalt in a large amount is necessary in such compositions because molybdenum has an adverse effect on toughness and hence cobalt, in large quantities, is essential to achieve high strength levels. Typical of later evolved compositions of this type was a grade 19 Ni(280) having C-0.03, Mn-0.10, Si-0.10, S-0.01, P-0.01, Ni-18–19, Co-8.5–9.5, Mo-4.6–5.2, Ti-0.5–0.8, Al-0.05–0.15, balance Fe. While such a composition gives good results in certain applications it is extremely expensive due, primarily, to the high Co content; at the present time the cost from the producer is about $12 per pound. Hence such compositions have only very few applications since users either design away from such a composition or work with less suitable materials.

Another type of precipitation hardening composition has been developed which is nickel based and which includes a grade known as Waspaloy. This type of composition also gives good results in certain applications, such as turbine blades, but like the 18% Ni compositions, the nickel based compositions are also very expensive, again largely attributable to the high Co content, and, in addition, are non-magnetic. The latter characteristic is a very serious drawback to the high volume producer who requires magnetic properties for scrap handling and charging. In addition, a magnetic material has the very desirable attribute of being capable of being machined using magnetic chuck as contrasted to conventional damping chucks, thereby making possible significant savings in cost and time. Thus this latter type of alloy, in addition to its high cost, has the further drawback of presenting processing problems for the producer.

It should also be noted that the physical characteristics of the above described alloys are generally less than are required in high stress end applications. A hot work implement such as a forging die for example represents one of the most, if not the most, rugged operating environments to which a ferrous alloy part can be subjected since such dies operate in a high temperature environment where they come into contact with work pieces which may be in the 1400°–1500° F. range, usually for short periods but occasionally for long dwell periods such as a .minute up to several minutes as when the die is used in isothermal forging, and very high impact loads. In this connection it should be noted that isothermal forging is often carried out in a vacuum or inert gas environment to avoid oxidation, and consequent scale formation, on the face of the die which would be more likely to occur with long dwell times. Such lengthy dwell times are the result of forging to size which is characteristic of isothermal forging. Such an application requires high strength, preferably in the 200,000–300,000 psi tensile range, high abrasion resistance, high ductility, and high toughness to withstand the extreme impact loads.

It is believed that few, if any, of the above described types of compositions have performed successfully as a forging die having magnetic properties, and, it is further believed, none have so performed on the basis of a cost which is reasonable in relation to the application, an exemplary cost being in the range of $3–$4 per pound.

SUMMARY OF THE INVENTION

The invention is a special propose tool, such as a turbine blade, or a hot work implement, made from a magnetic, precipitation hardening cobalt free maraging type ferrous alloy which is suitable for use as, for example, a forging die at a cost to the user of only about ¼–⅓ of the current cost of such implements, and a method of manufacture thereof. The tool or implement is made from a ferrous alloy having a broad composition of the following approximate ranges:

| | |
|---|---|
| C | less than .20 |
| Mn | .80 max |
| P | .015 max |
| S | .010 max |
| Si | .15–.35 |
| Ni | 6.00–16.00 |
| Cr | 6.00–14.00 |
| Mo | 2.00–6.00 |
| V | 0.03–.15 |
| Ti | 0.0–4.00 |
| Al | .20–8.00 |
| Fe | balance together with incidental impurities and other elements not significantly affecting performance |

Said hot work implement, which will hereafter be referred to as a forging die, or tool made by electric furnace steelmaking techniques, without utilizing sophisticated post-melting treatment techniques, from a ferrous alloy having the following composition:

| | |
|---|---|
| C | .09–.20 |
| Mn | .80 max |
| P | .015 max |
| S | .010 max |
| Si | .15–.35 |
| Ni | 6.00–16.00 |
| Cr | 6.00–14.00 |
| Mo | 2.00–6.00 |
| V | .05–.15 |
| Ti | 0.10–4.00 |
| Al | .20–8.00 |
| Fe | balance together with incidental impurities and other elements not significantly affecting performance |

DESCRIPTION OF THE INVENTION

A typical hot work forging die may be either round or rectangular in plan outline. In almost all cases a large bar or block is cut in half or otherwise separated into two pieces and, thereafter, an impression is formed in, usually, both halves of the material. Preferably the material is in a relatively soft condition at the time the tool and die maker sinks the impression in each piece.

After the die sinker completes his work the material can then be hardened to its final, operating condition prior to installation in a forging hammer where it is used to shape a blank workpiece into the configuration of the impression in the die. When the impression goes oversize to the point where the parts produced are no longer in specification the dies are removed from the press and a new impression is sunk which will produce parts within specification. The composition of the ferrous alloy is important to its proper performance. A composition of a ferrous alloy suitable for use in a forging die is as follows:

| | |
|---|---|
| C | less than .20 |
| Mn | 0.80 max |
| P | 0.015 max |
| S | 0.010 max |
| Si | 0.15–0.35 |
| Ni | 6.00–16.00 |
| Cr | 6.00–14.00 |
| Mo | 2.00–6.00 |
| V | 0.05–.15 |
| Ti | 0.10–4.00 |
| Al | 0.20–8.00 |
| Fe | balance together with incidental impurities and other elements not significantly affecting performance |

after heat treatment the ferrous alloy will be characterized by uniformly dispersed strengthening precipitates including $Ni_3Mo$, $Ni_3Al$, and Ni3Ti.

Carbon imparts strength and hardness to the ferrous alloy which are important characteristics of a forging die. Carbon does, however, have the adverse characteristic of depleting Cr and Mo by forming carbide precipitates of these elements at the grain boundaries. A high percentage of Cr which is initially added to the composition must exist in the final product in order to obtain the desired corrosion resistance without requiring the presence of unduly large amounts of this relatively expensive element. By the same token, since large C contents are not tolerable, $Ni_3Mo$ precipitate must be relied on to provide the high strength required in the extremely rugged operating environment of a forging die. Since Mo will combine with C in preference to combining with Ni, the C must, of necessity, be carefully controlled to ensure the formation of adequate quantities of strengthening $Ni_3Mo$ precipitates to attain the essential high strength characteristics of the steel. C makes a contribution to the strength levels demanded by the end use of a forging die, but no more than 0.20 C should be present to prevent unacceptable Cr and Mo depletion with the adverse consequences described above. One occasion, C in the range of 0.09 to 0.20 can be tolerated. Preferably, when C is present in the upper 5 points of said range, Cr should be present in the range of at least 11–13%.

Mn is, in effect, an impurity. A maximum Mn is included primarily to accommodate the practicalities of ferrous metallurgy, and particularly the fact that most scrap contains a significant amount of Mn and, also, to control the potentially adverse effects of S, which, if present in undesirably large quantities, can produce highly undesirable sulfide stringer inclusions. Perferably Mn is present in an amount about 15 times the S.

P should be maintained at or below 0.015 to prevent embrittlement.

S should be maintained at or below 0.010 to ensure good polishability of a forging die, and to avoid any adverse impact on mechanical properties, including the formation of inclusions in an undesirable from, such as manganese sulfide stringers.

Si is present to facilitate deoxidation as is now well known in the art.

Ni promotes the formation of. $Ni_3Mo$, $Ni_3Al$ and $Ni_3Ti$ precipitates for the primary purpose of strengthening the steel. Although current results are not conclusive it is believed that Ni in the lower end of its stated ranges, and specifically in the range of 6–8%, will be suitable for many applications particularly those in which the die cavity is not complex.

Cr is present to enhance corrosion resistance and prevent embrittlement. Sufficient Cr must be present to tie up the C so that undesirable carbide precipitates formed at the grain boundaries are eliminated or permitted to form only in amounts which will not adversely affect the desired properties.

Mo is necessary to provide a source for forming $Ni_3Mo$ precipitates for strengthening.

V is important in the control of grain size. It is highly desirable that a grain as fine as can be feasibly provided be present in a forging die to promote wear resistance and reduce the incidence of pitting and cracking, all of which will decrease the production obtainable from the initial and each subsequent sinking of the die. If much less than 0.03 is present the desired grain size control may not be achieved. If much more than 0.15 is present the effect of the excess may be insignificant and the cost-benefit ratio will be adversely affected since V is a very expensive element. More preferably, V in a minimum amount of 0.05 is desirable to ensure that sufficient free V will be available to produce the fine grain size desired.

Ti provides a source for the $Ni_3$ Ti precipitates for strengthening.

Al is necessary to form $Ni_3Al$ precipitates for strengthening and, also, to facilitate balanced deoxidation dating the manufacture of the alloy.

A forging die formed from the foregoing composition will, at current prices, cost only about ⅓ to ¼ as much as known maraging compositions; that is, only about $3–$4 per pound.

A specific heat was made up within the broad ranges discussed above as follows:

| | |
|---|---|
| C | .005 |
| Mn | .012 |
| P | .010 |
| S | .010 |
| Si | — |
| Ni | 6.46 |
| Cr | 11.90 |
| Mo | 3.97 |
| V | 0.05 |
| Ti | 0.19 |
| Al | 0.57 |
| Fe | balance |

Tests on said composition indicate that the material has the desired precipitation hardening characteristics.

It will be noted that the composition of both the broad ranges and the specific formulation are ferritic and hence magnetic as contrasted to other precipitation hardening alloys which are nickel based. Further, the ferrous alloys from the foregoing composition are much less expensive than all other precipitation hardening compositions which have substantial Co contents.

It will be understood that when a conventional, non-maraging medium carbon low alloy product suitable for the above described applications is quenched it is at its maximum hardness. Although subsequent heat treatment can and conventionally does change the characteristics of such a product very substantially, the hardness level is relatively high and subsequent processing, such as die sinking, must be performed at such high hardness levels—which may be in the range of $R_c30$ to $R_c40$ or even somewhat more.

By contrast, the ferrous alloy maraging product of the invention is solution treated after quenching and thus, after quenching, is at its lowest hardness—of which $R_c24$ would be a conventional value. As a consequence, the producer can sell the product to the end user in the soft, solution treated condition, the end user can machine a blank at the low hardness level, and, once final size has been reached at the end of machining, the end user can temper with the result that the hardness increases.

Further, the hardness will increase without warpage. A typical temper would be at 1000° F. during which time it is believed that precipitation occurs with a consequent increase in hardness. It will be appreciated that the low level of C significantly contributes to the low as-quenched hardness which is another reason for using very low C levels.

The final material will be excellent for high temperature heat resistance applications. Thus, should a hot work piece become stuck in a forging die made of the herein disclosed ferrous alloy and thus a long dwell time be experienced, no deleterious effect on the forging die will result. By contrast, with some conventional materials used as forging dies, the die will temper back, which is in marked contrast to the increased hardness which will result from a long dwell time or a hot work piece in a die of the present composition;

The ferrous alloy of this invention, and particularly those compositions having very low C contents may be made by a process which includes forming an electric furnace batch of molten ferrous alloy of any desired size, such as about 65 tons, which contains significant quantities of included oxygen, but an insignificant quantity of carbon and aluminum, subjecting said batch to the combined effect of a vacuum, a purging gas which is bubbled upwardly through the batch, and an alternating current heating arc which is stuck directly between carbon type electrodes and the ferrous alloy, said vacuum being sufficiently low to substantially remove oxygen, hydrogen and nitrogen from the alloy, such as about 0.5 mm Hg to 100 mm Hg., and thereafter, while the ferrous alloy has a very low included oxygen content, adding alloying quantities of aluminum to the batch to yield a final aluminum content in the range of 0.20 to 8.00% by weight. Further description of suitable processing parameters may be found in U.S. Pat. Nos. 3,501,289, 3,635,696 and 4,069,039, the disclosures of which are incorporated herein by reference. Alternatively a batch of smaller size may be made by a vacuum arc remelt process of which a representative system and processing sequence is described in U.S. Pat. No. 5,252,120, the disclosure of which is incorporated herein by reference. Compositions having higher C contents than those compatible with the vacuum arc degassing and the vacuum arc remelt process may be made by carefully controlled electric arc furnace processing.

While a specific embodiment of the present invention has been described, it will at once be apparent to those skilled in the art that variations may be made within the spirit and scope of the present invention. Accordingly, it is intended that the scope of the invention be limited solely by the scope of the hereafter appended claims and not by any specific wording in the foregoing description.

What is claimed is:

1. A maraging type hot work implement such as a forging die or a tool such as a turbine blade characterized, firstly, in that said product is magnetic, has strengthening $Ni_3Mo$, $Ni_3Ti$ and $Ni_3Al$ precipitates uniformly dispersed, and is substantially Co free, and secondly in that said product has the following approximate composition by weight percent:

| | |
|---|---|
| C | less than .20 |
| Mn | .80 max |
| P | .015 max |
| S | .010 max |
| Si | .15–.35 |
| Ni | 6.00–16.00 |
| Cr | 6.00–14.00 |
| Mo | 2.00–6.00 |
| V | 0.03–.15 |
| Ti | 4.00 max |
| Al | .20–8.00 |
| Fe | balance and incidental impurities and other elements not significantly adversely affecting performance. |

2. The product of claim 1 further characterized, firstly, in that said product is magnetic, has $Ni_3Mo$, $Ni_3Al$ and $Ni_3Ti$ strengthening precipitates dispersed uniformly, and is substantially Co free, and secondly, in that said product has the following approximate composition by weight percent:

| | |
|---|---|
| C | .09–.20 |
| Mn | .80 max |
| P | .015 max |
| S | .010 max |
| Si | .15–.35 |
| Ni | 6.00–16.00 |
| Cr | 6.00–14.00 |
| Mo | 2.00–6.00 |
| V | 0.03–.15 |
| Ti | .10–4.00 |
| Al | .20–8.00 |
| Fe | balance together with impurities and other elements not significantly adversely affecting performance. |

3. The product claim 2 further characterized in that said product has the following approximate composition weight percent:

| | |
|---|---|
| C | .09–.20 |
| Mn | .80 max |
| P | .015 max |
| S | .010 max |
| Si | .15–.35 |
| Ni | 6–16 |
| Cr | 11–13 when C is present near the upper end of its range |
| Mo | 2.00–6.00 |
| V | 0.05–.15 |
| Ti | 0.10–4.0 |
| Al | 0.20–8.00 |
| Fe | balance together with impurities and other elements not significantly adversely affecting performance. |

4. In a method of making a maraging type hot work product the steps of forming an electric furnace batch of molten ferrous alloy of any desired size which contains significant quantities of included oxygen, but (1) a quantity of carbon insufficient to affect the final desired properties of the product, and (2) an insignificant quantity of aluminum, subjecting the batch to the combined effect of a vacuum and a purging gas which is bubbled upwardly through the batch, said vacuum being sufficiently low to substantially remove oxygen, hydrogen and nitrogen from the alloy, and thereafter, while the ferrous alloy has a very low included oxygen content, adding alloying quantities of aluminum to the batch to yield as a final composition:

| | |
|---|---|
| C | less than .20 |
| Mn | .80 max |
| P | .015 max |
| S | .010 max |
| Si | .15–.35 |
| Ni | 6.00–16.00 |
| Cr | 6.00–14.00 |
| Mo | 2.00–6.00 |
| V | 0.3–.15 |
| Ti | 4.00 max |
| Al | .20–8.00 |
| Fe | balance together with incidental impurities and other elements not significantly adversely affecting performance. |

5. The method of claim 4 further characterized in that the batch is subjected to the combined effect of an electric arc in combination with the combined effect of a vacuum and a purging gas.

6. The method of claim 5 further characterized in that the electric arc is an alternating current arc.

7. The method of claim 5 further characterized in that the electric arc is a direct current arc.

8. The method of claim 4 further characterized in that the batch constituents are adjusted to yield as a final composition:

| | |
|---|---|
| C | .09–.20 |
| Mn | .80 max |
| P | .015 max |
| S | .010 max |
| Si | .15–.35 |
| Ni | 6.00–16.00 |
| Cr | 6.00–14.00 |
| V | .05–.15 |
| Ti | .10–4.00 |
| Al | .20–8.00 |
| Fe | balance together with incidental impurities and other elements not significantly adversely affecting performance. |

* * * * *